US008480947B2

(12) United States Patent
Saarinen et al.

(10) Patent No.: US 8,480,947 B2
(45) Date of Patent: Jul. 9, 2013

(54) METHOD FOR MANUFACTURING A COOLING ELEMENT AND A COOLING ELEMENT

(75) Inventors: Risto Saarinen, Espoo (FI); Eero Hugg, Espoo (FI); Mikael Jafs, Espoo (FI)

(73) Assignee: Outotec Oyj, Espoo (FI)

( * ) Notice: Subject to any disclaimer, the term of this patent is extended or adjusted under 35 U.S.C. 154(b) by 265 days.

(21) Appl. No.: 13/001,678

(22) PCT Filed: Jun. 30, 2009

(86) PCT No.: PCT/FI2009/050592
§ 371 (c)(1),
(2), (4) Date: Dec. 28, 2010

(87) PCT Pub. No.: WO2010/000939
PCT Pub. Date: Jan. 7, 2010

(65) Prior Publication Data

US 2011/0108235 A1 May 12, 2011

(30) Foreign Application Priority Data

Jun. 30, 2008 (FI) ..... 20085669

(51) Int. Cl.
*B21D 53/02* (2006.01)

(52) U.S. Cl.
USPC ..... 266/46; 266/194; 266/241

(58) Field of Classification Search
USPC ..... 266/46, 193, 194, 241
See application file for complete search history.

(56) References Cited

U.S. PATENT DOCUMENTS 6,221,312 B1 * 4/2001 Van Laar et al. ..... 266/193
2003/0038164 A1 2/2003 Saarinen et al.

(Continued)

FOREIGN PATENT DOCUMENTS

FI 20002408 A 5/2002
FI 109937 B 10/2002

(Continued)

OTHER PUBLICATIONS

International Preliminary Report on Patentability (Form PCT/IB/373) and Written Opinion of the International Searching Authority(Form PCT/ISA/237) mailed in International Application No. PCT/FI2009/050592, Jan. 5, 2011, The International Bureau of WIPO, Geneva, CH (Continued)

*Primary Examiner* — Scott Kastler
(74) *Attorney, Agent, or Firm* — Buchanan Ingersoll & Rooney PC

(57) ABSTRACT

A method for manufacturing a cooling element for a metallurgical furnace, wherein there is arranged a frame element mainly made of copper and provided with water cooling channels; in the frame element, there are arranged fastening elements for connecting refractory bricks to the frame element; and refractory bricks are connected to the frame element by using fastening elements; and wherein the fastening elements are at least partly formed of elongate steel fastening strips; the method comprising fastening the elongate fastening steel strips to the frame element so that the elongate fastening steel strips together form in between them an open interspace, which is narrowed in a direction pointed away from the bottom of the open interspace; and arranging refractory bricks in the open interspace so that the refractory bricks are located at least partly in the open interspace. A cooling element to be used in connection with a metallurgical furnace or the like is made mainly of copper and includes water cooling channels.

20 Claims, 3 Drawing Sheets

U.S. PATENT DOCUMENTS

Figure 1:
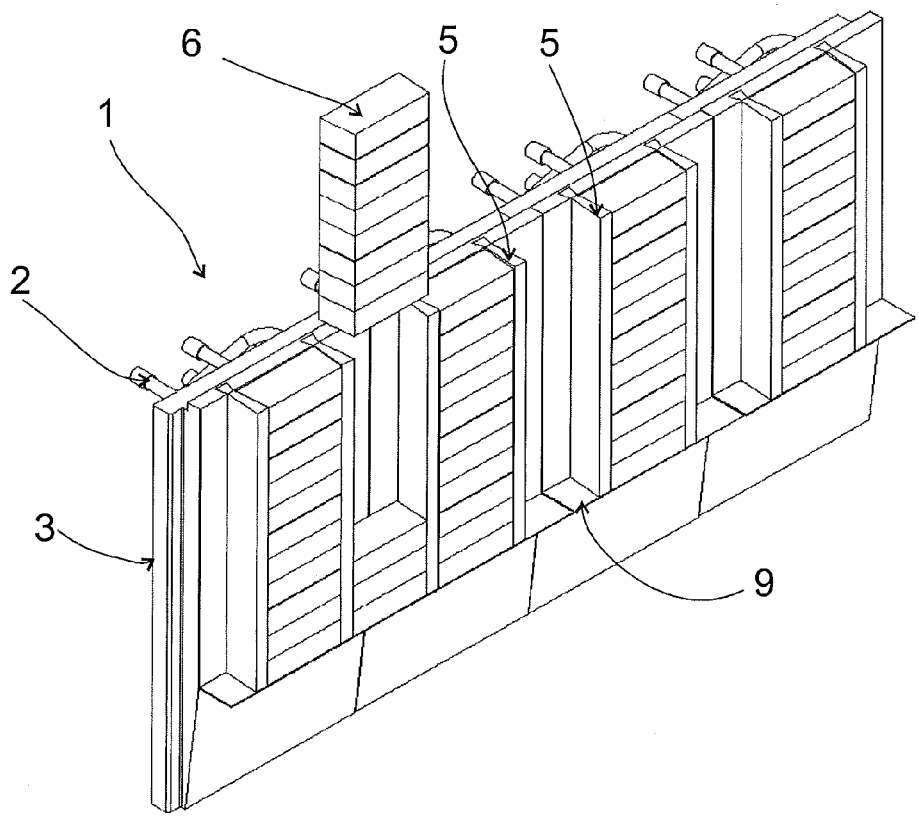

| | | | |
|---|---|---|---|
| 2004/0051218 | A1 | 3/2004 | Saarinen et al. |
| 2006/0049554 | A1 | 3/2006 | Saarinen et al. |

FOREIGN PATENT DOCUMENTS

| | | | |
|---|---|---|---|
| FI | 112534 | B | 12/2003 |
| FI | 115251 | B | 3/2005 |
| FI | 117768 | B | 2/2007 |
| GB | 1 439 137 | A | 6/1976 |
| WO | WO 01/71267 | A2 | 9/2001 |
| WO | WO 02/37044 | A1 | 5/2002 |
| WO | WO 2004/011866 | A1 | 2/2004 |
| WO | WO 2009/146980 | A1 * | 10/2009 |
| WO | WO 2009/147192 | A1 * | 10/2009 |

OTHER PUBLICATIONS

International Search Report (PCT/ISA/210) dated Oct. 27, 2009.
Finnish Search Report dated Feb. 9, 2009.

* cited by examiner

METHOD FOR MANUFACTURING A COOLING ELEMENT AND A COOLING ELEMENT

BACKGROUND OF INVENTION

The invention relates to a method for manufacturing a cooling element used in connection with a metallurgic furnace or the like, in which method there is arranged a frame element, being mainly made of copper and including water cooling channels; the frame element is provided with fastening elements for connecting refractory bricks to the frame element; and refractory bricks are connected to the frame element by using the fastening elements.

The invention also relates to a cooling element used in connection with a metallurgic furnace or the like, being mainly made of copper and including water cooling channels, said cooling element comprising a frame element being mainly made of copper and including water cooling channels, refractory bricks and fastening elements for connecting refractory bricks to the frame element.

The invention also relates to a cooling element according to the preamble of claim 11, used in connection with a metallurgic furnace or the like, being mainly made of copper and including water cooling channels, said cooling element comprising a frame element being mainly made of copper and including water cooling channels, refractory bricks and fastening elements for connecting refractory bricks to the frame element.

In the prior art there are known various different methods for manufacturing a cooling element comprising a frame element being mainly made of copper and including water cooling channels, and refractory bricks that are fastened to the frame element by fastening elements. This kind of cooling element is fitted for example in a metallurgical furnace so that the brick lining formed of refractory bricks is in contact with molten metal. Together with the metallurgical furnace, the brick linings fitted in the metallurgical furnace form a structure that is in contact with molten metal. The purpose with this kind of cooling element is that part of the thermal energy directed to the brick lining by the molten metal is transferred from the brick lining to the frame element provided with water cooling, and as a consequence, the brick lining is cooled. Therefore, in between the frame element and the brick lining, there should be arranged a thermal contact that is as good as possible.

One problem with this kind of cooling elements has, however, conventionally been that in the course of time, in between the refractory bricks and the frame element, there can be created a gap that prevents heat from being transferred from the brick lining to the frame element. This results in that the bricks are not cooled, and as a consequence, they are damaged, which may further result in a situation where the cooling element itself is subjected to a thermal stress so high that the whole cooling element is damaged.

From the Finnish patent publication 109937 there is known a composite cooling element that is manufactured by joining the elements of the ceramic lining together by copper casting, and by at the same time arranging at the back of the lining a copper plate that is provided with cooling water channels. The invention described in said Finnish patent publication 109937 also relates to a composite cooling element manufactured by said method.

From the Finnish patent publication 20002408 there is known a cooling element, particularly designed to be used in connection with producing metals in a flash converting furnace, said cooling element comprising a frame element, which is provided with a channel system for the cooling water circulation, and on the frame element surface on the side of the furnace space, there are made grooves where elements of the furnace lining can be arranged. The frame element is mainly made of copper, and on the frame element surface on the side of the furnace, there are made grooves where elements of the ceramic lining of the furnace can be arranged, and grooves where there are fitted steel elements, so that at least that part of the cooling element surface placed in the area of the border surface between the molten metal and molten slag that may get into contact with the molten metal, is made of steel.

BRIEF DESCRIPTION OF INVENTION

An object of the invention is to realize a method for manufacturing a cooling element used in connection with a metallurgical furnace or the like, by which method there can be manufactured a cooling element that has a particularly good thermal contact between the frame element and the refractory bricks.

Another object of the invention is to realize a cooling element used in connection with a metallurgical furnace or the like, said cooling element being mainly made of copper and provided with water cooling channels, and having a particularly good thermal contact between the frame element and the refractory bricks.

The object of the invention is achieved by a method for manufacturing a cooling element used in connection with a metallurgical furnace or the like, said cooling element being mainly made of copper and provided with water cooling channels.

The invention also relates to a cooling element used in connection with a metallurgical furnace or the like, said cooling element being mainly made of copper and provided with water cooling channels.

The method according to the invention is based on the principle that the fastening elements are at least partly composed of elongate fastening strips made of steel, which strips are fastened to the frame element, so that the elongate fastening steel strips together form in between them an open interspace that is narrowed in the direction pointed away from the bottom of the open interspace, and that the refractory bricks are arranged in the open interspace so that said refractory bricks are located at least partly in said open interspace.

A cooling element according to the invention is provided with fastening elements for connecting refractory bricks to the frame element. The fastening elements are at least partly formed of elongate fastening strips made of steel. The elongate fastening steel strips are fastened to the frame element so that the elongate fastening steel strips together form in between them an open interspace that is narrowed in the direction pointed away from the bottom of the open interspace. The open interspace is narrowed preferably, but not necessarily, in a wedge-like fashion in the direction pointed away from the bottom of the open interspace. The refractory bricks are arranged in the open interspace so that said refractory bricks are located at least partly in the open interspace that is narrowed in the direction pointed away from the bottom of the open interspace.

In an arrangement according to the invention, the open interspace that is narrowed in the direction pointed away from the bottom of said open interspace prevents the frame element from moving with respect to the bricks and vice versa. As a result, there is obtained a good joint between the frame element and the brick, and as a consequence, thermal energy is efficiently transferred in between the frame element and the brick.

In a preferred embodiment of the arrangement according to the invention, in the open interspace there are arranged such refractory bricks that the refractory bricks together form a uniform structure, said structure including a section located in the open interspace and having measures and shape that at least partly correspond to the measures and shape of the open interspace. In this way, there is obtained a joint corresponding to a foam-fitted joint in between the refractory bricks and the frame element, which joint is capable of efficiently preventing the refractory bricks from moving with respect to the frame element, and which thus ensures good heat transfer properties in between the refractory bricks and the frame element.

In a preferred embodiment of the arrangement according to the invention, in the open interspace there are arranged such refractory bricks that said refractory bricks together form a uniform structure, which is located essentially completely in the open interspace and has measures and shape that at least partly correspond to the measures and shape of the open interspace. In this way, there is obtained a joint corresponding to a form-fitted joint in between the refractory bricks and the frame element, which joint is capable of efficiently preventing the refractory bricks from moving with respect to the frame element, and which thus ensures good heat transfer properties in between the refractory bricks and the frame element.

In a preferred embodiment of the arrangement according to the invention, the open interspace is created by fastening the elongate fastening steel strips to the frame element so that the open interspace, which is narrowed in the direction pointed away from the bottom of the open interspace, is formed in between two elongate fastening steel strips, and so that the bottom of the open interspace is configured of the surface of the frame element. In this way, the joint obtained in between the refractory bricks and the frame element has good properties for transferring thermal energy, because the refractory bricks are in direct contact with the frame element, and this ensures good heat transfer properties in between the refractory bricks and the frame element.

In a preferred embodiment of the arrangement according to the invention, the open interspace is created by fastening the elongate fastening steel strips to the frame element, so that the open interspace is created in between two elongate fastening steel strips, and to the frame element there is fastened at least one elongate fastening steel strip, the cross-sectional area of which expands in the direction pointed away from the bottom of the open interspace, so that the open interspace formed in between two elongate fastening steel strips is narrowed in the direction pointed away from the bottom of the open interspace.

In a preferred embodiment of the arrangement according to the invention, the elongate fastening steel strip is fastened to the frame element by machining in the frame element an elongate groove for an elongate fastening steel strip, so that the measures and shape of the section of the elongate fastening steel strip that is to be fitted in the elongate groove essentially correspond to the measures and shape of the elongate groove for realizing a friction-fitted or form-fitted joint in between the elongate fastening steel strip and the elongate groove.

In a preferred embodiment of the arrangement according to the invention, the elongate fastening steel strips are made of stainless steel, the chromium content of which is over 10.5%, advantageously of stainless steel according to the standard EN 10095 (Fireproof steels and nickel alloys).

In a preferred embodiment of the arrangement according to the invention, the elongate fastening steel strips are made of stainless steel, the chromium content of which is of the order 17-30%, such as 22-24%, 24-29%, or 29-30%.

In a preferred embodiment of the arrangement according to the invention, there is provided a stopping piece for holding the refractory bricks in the open interspace, and said stopping piece is arranged so that it is located in between two elongate fastening steel strips, and so that it is located at the other end of the interspace formed in between two elongate fastening steel strips. In particular, in case the open interspace shall extend vertically when using the cooling element, the cooling element must have an arrangement for holding the refractory bricks in the open interspace, and this kind of stopping piece is well suited in this purpose.

LIST OF DRAWINGS

Figure 2:
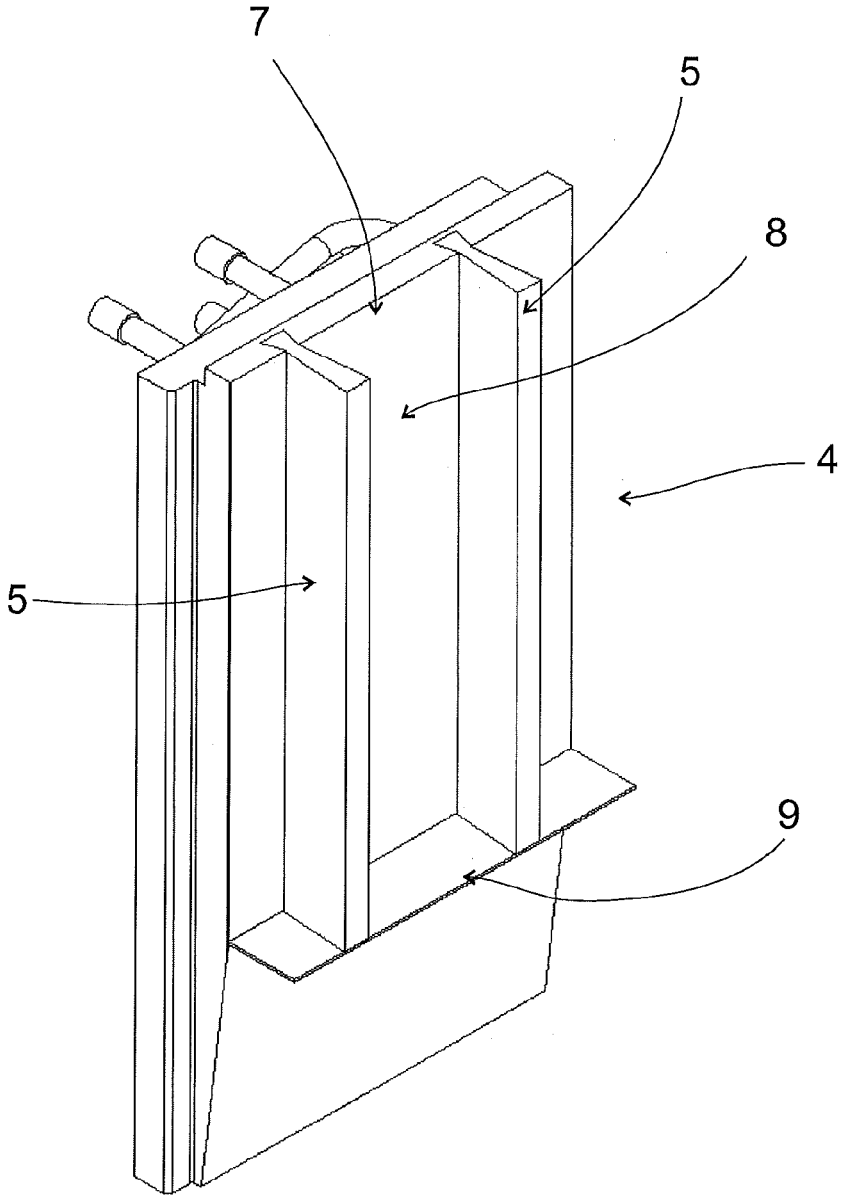
Figure 3:
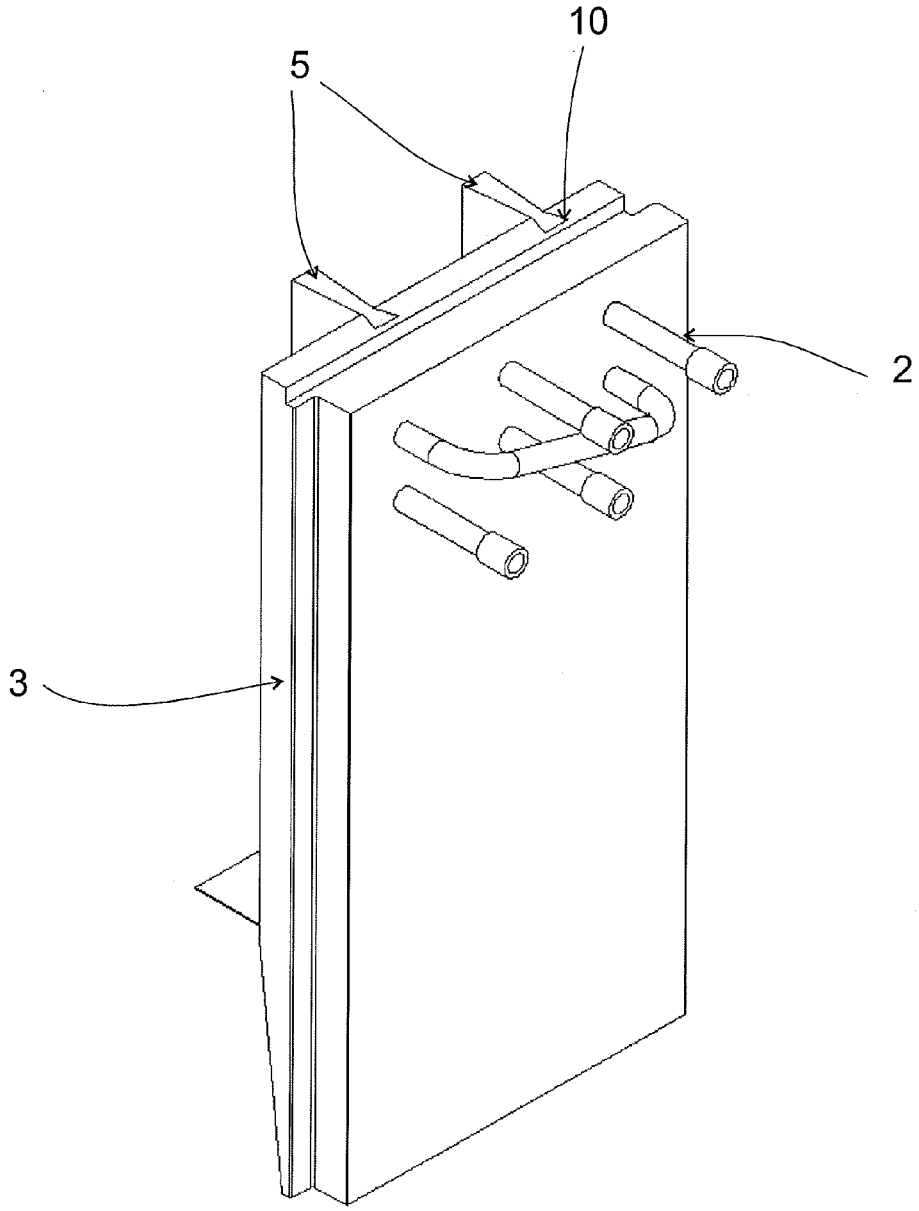

A few preferred embodiments of the invention are described in more detail below with reference to the appended drawings, where FIG. 1 illustrates a structure comprising several cooling elements, FIG. 2 illustrates a preferred embodiment of a cooling element according to the invention, including a frame element to which there are fastened elongate fastening steel strips, and a stopping piece in between the elongate fastening steel strips, and FIG. 3 illustrates the cooling element of FIG. 2, viewed from another angle.

DETAILED DESCRIPTION OF INVENTION

The invention relates to a method for manufacturing a cooling element 1 to be used in connection with a metallurgical furnace or the like, and to a cooling element 1 to be used in connection with a metallurgical furnace or the like, being mainly made of copper and provided with water cooling channels 2.

The method according to the invention for manufacturing a cooling element 1 to be used in connection with a metallurgical furnace or the like is described in more detail first.

In the method, there is provided a frame element 3 being mainly made of copper and provided with water cooling channels 2.

In the method, in the frame element 3 there are provided fastening elements 4 for connecting refractory bricks 6 to the frame element 3. The refractory bricks 6 are advantageously connected to that surface of the frame element 3 that is turned to face the molten metal, when the cooling element 1 is installed in a metallurgical furnace or the like, and when the cooling element 1 is being used in a metallurgical furnace or the like.

In the method, refractory bricks 6 are connected to the frame element 3 by using fastening elements 4.

In the method, the fastening elements 4 are at least partly made of elongate fastening strips made of steel 5. The elongate fastening steel strips 5 are fastened to the frame element 3 so that the elongate fastening steel strips 5 together form in between them an open interspace 7, which is narrowed in a direction pointed away from the bottom 8 of the open interspace 7. The refractory bricks 6 are arranged in the open interspace 7, so that the refractory bricks 6 are located at least partly in the open interspace 7.

The open interspace 7 is narrowed preferably, but not necessarily, in a wedge-like fashion in a direction pointed away from the bottom 8 of the open interspace 7.

The elongate fastening steel strips 5 are fastened preferably, but not necessarily, to the frame element 3 so that in the frame element, there are made, for example by machining, elongate grooves 10 for the elongate fastening steel strips 5. In case the frame element 3 is provided with elongate grooves 10 for the elongate fastening steel strips 5, the elongate grooves 10 are made preferably, but not necessarily, so that in between an elongate groove 10 and an elongate fastening steel strip 5, there is created a form-fitted or friction-fitted joint for holding the elongate fastening steel strip 5 in the elongate groove 10. In the drawings, in between each elongate groove 10 and each elongate fastening steel strip 5, there is made a dovetail type joint. As an alternative, the elongate fastening steel strips 5 can also be cast directly in the frame element 3, for example in one and the same casting step, in case the frame element 3 is manufactured by casting.

In the method, in the open interspace 7 there are arranged preferably, but not necessarily, such refractory bricks 6 that the refractory bricks 6 together form a uniform structure having a section placed in the open interspace 7, the measures and shape of said section at least partly corresponding to the measures and shape of the open interspace 7.

In the method, in the open interspace 7 there are arranged preferably, but not necessarily, such refractory bricks 6 that the refractory bricks 6 together form a uniform structure, which is located essentially completely in the open interspace 7 and the measures and shape of which least partly correspond to the measures and shape of the open interspace 7.

The open interspace 7 is made preferably, but not necessarily, by fastening the elongate fastening steel strips 5 to the frame element 3, so that the open interspace 7 is formed in between two elongate fastening steel strips 5.

The elongate fastening steel strips 5 are fastened to the frame element 3 preferably, but not necessarily, so that the bottom 8 of the open interspace 7 is at least partly, but preferably completely, formed of the surface of the frame element 3.

In the method, to the frame element 3 there is preferably, but not necessarily, fastened at least one elongate fastening steel strip 5, the cross-sectional area of which expands in a direction pointed away from the bottom 8 of the open interspace 7, so that the open interspace formed in between two elongate fastening steel strips 5 is narrowed in a direction pointed away from the bottom 8 of the open interspace 7.

The elongate fastening steel strips 5 are preferably, but not necessarily, made of stainless steel, the chromium content of which is over 10.5%, advantageously of stainless steel according to the standard EN 10095 (Fireproof steels and nickel alloys).

The elongate fastening steel strips 5 can be preferably, but not necessarily, made of stainless steel, the chromium content of which is of the order 17-30%, such as 22-24%, 24-9%, or 29-30%.

In the method, there is preferably, but not necessarily, provided a stopping piece 9 for holding the refractory bricks 6 in the open interspace 7. The stopping piece 9 is preferably, but not necessarily, arranged so that it connects two elongate fastening steel strips 5, and so that it is located at the other end of the interspace 7 formed in between two elongate fastening steel strips 5.

The invention also relates to a cooling element 1 to be used in connection with a metallurgical furnace or the like, said cooling element being mainly made of copper and provided with water cooling channels 2.

The cooling element 1 comprises a frame element 3 that is mainly made of copper and provided with water cooling channels 2.

In addition, the cooling element 1 comprises refractory bricks 6 and fastening elements 4 for connecting the refractory bricks 6 to the frame element 3.

The fastening elements 4 are at least partly formed of elongate fastening strips made of steel 5.

The elongate fastening steel strips 5 are fastened to the frame element 3, so that the elongate fastening steel strips 5 together form in between them an open interspace 7, which is narrowed in a direction pointed away from the bottom 8 of the open interspace 7. The open interspace 7 is preferably, but not necessarily, narrowed in a wedge-like fashion in a direction pointed away from the bottom 8 of the open interspace 7.

The refractory bricks 6 are arranged in the open interspace 7 so that the refractory bricks 6 are located at least partly in the open interspace 7.

The elongate fastening steel strips 5 are preferably, but not necessarily, fastened to the frame element 3, so that in the frame element 3, there is made, for instance by machining, elongate grooves 10 for the elongate fastening steel strips 5. In case elongate grooves 10 are made in the frame element 3 for the elongate fastening steel strips 5, the elongate grooves 10 are preferably, but not necessarily, made so that in between an elongate groove 10 and an elongate fastening steel strip 5, there is created a form-fitted or friction-fitted joint for holding the elongate fastening steel strip 5 in the elongate groove 10. In the drawings, in between each elongate groove 10 and each elongate fastening steel strip 5, there is formed a dovetail type joint. As an alternative, the elongate fastening steel strips 5 can be cast directly in the frame element 3, for example in the same casting step, in case the frame element 3 is manufactured by casting.

Together the refractory bricks 6 form preferably, but not necessarily, a uniform structure that includes a section located in the open interspace 7, the measures and shape of said section at least partly corresponding to the measures and shape of the open interspace 7.

As an alternative, the refractory bricks 6 can together form, preferably, but not necessarily, a uniform structure that is located essentially completely in the open interspace 7, the measures and shape of said structure at least partly corresponding to the measures and shape of the open interspace 7.

The open interspace 7 is created preferably, but not necessarily, by fastening the elongate fastening steel strips 5 to the frame element 3, so that the open interspace 7 is created between two elongate fastening steel strips 5.

The elongate fastening steel strips 5 are preferably, but not necessarily, fastened to the frame element 3 so that the bottom 8 of the open interspace 7 is formed of at least partly of the surface of the frame element 3.

To the frame element 3, there is preferably, but not necessarily, fastened at least one elongate fastening steel strip 5, the cross-sectional area of which expands in a direction that is pointed away from the bottom 8 of the open interspace 7, so that the open interspace 7 created between two elongate fastening steel strips 5 is narrowed in a direction pointed away from the bottom 8 of the open interspace 7.

The elongate fastening steel strips 5 are preferably, but not necessarily, made of stainless steel, the chromium content of which is over 10.5%, preferably of stainless steel according to the standard EN 10095 (Fireproof steels and nickel alloys).

For example, the elongate fastening steel strips 5 are made of stainless steel, the chromium content of which is of the order 17-30%, such as 22-24%, 24-29% or 29-30%.

The cooling element 1 comprises preferably, but not necessarily, a stopping piece 9 for holding the refractory bricks 6 in the open interspace 7. The stopping piece 9 can be such that it connects two elongate fastening steel strips 5, so that the stopping piece 9 is located at the other end of the interspace 7 created in between two elongate fastening steel strips 5.

For a man skilled in the art, it is obvious that along with the development of technology, the basic idea of the invention can be realized in many different ways. Thus the invention and its preferred embodiments are not restricted to the examples described above, but they can vary within the scope of the appended claims.

The invention claimed is:

1. A method for manufacturing a cooling element for a metallurgical furnace wherein there is disposed a frame element mainly made of copper and provided with water cooling channels, and disposed within the frame element fastening elements for connecting refractory bricks to the frame element, and wherein the refractory bricks are connected to the frame element by the fastening elements, and the fastening elements include elongate fastening strips made of steel, said method comprising: fastening the elongate fastening steel strips to the frame element so that the elongate fastening steel strips together form in between them an open interspace, which is narrowed in a direction pointed away from the bottom of the open interspace, and arranging the refractory bricks in the open interspace so that the refractory bricks are located at least partly in the open interspace.

2. A method according to claim 1, wherein refractory bricks are arranged such that the refractory bricks together form a uniform structure that has a section located in the open interspace, the measures and shape of said section at least partly corresponding to the measures and shape of the open interspace.

3. A method according to claim 1, wherein refractory bricks are arranged such that the refractory bricks together form a uniform structure, which is located essentially completely in the open interspace, the measures and shape of said structure at least partly corresponding to the measures and shape of the open interspace.

4. A method according to claim 1, wherein the open interspace is created by fastening elongate fastening steel strips to the frame element, so that the open interspace is created between two elongate fastening steel strips.

5. A method according to claim 4, comprising fastening to the frame element at least one elongate fastening steel strip, the cross-sectional area of which expands in a direction pointed away from the bottom of the open interspace, so that the open interspace created between two elongate fastening steel strips is narrowed in a direction pointed away from the bottom of the open interspace.

6. A method according to claim 1, wherein the open interspace is narrowed in a wedge-like fashion in a direction pointed away from the bottom of the open interspace.

7. A method according to claim 1, wherein the elongate fastening steel strips are made of stainless steel, the chromium content of which is over 10.5%.

8. A method according to claim 1, further comprising introducing a stopping piece for holding the refractory bricks in the open interspace.

9. A method according to claim 1, further comprising a step of fastening an elongate fastening steel strip to the frame element by machining an elongate groove in the frame element for the elongate fastening steel strips, so that the measures and shape of the elongate fastening steel strip to be fitted in the elongate groove correspond to the measures and shape of the elongate groove for forming a friction-fitted or form-fitted joint between the elongate fastening steel strip and the elongate groove.

10. A method according to claim 1, wherein the open interspace is created by fastening elongate fastening steel strips to the frame element so that the bottom of the open interspace is at least partly formed of the surface of the frame element.

11. A cooling element for a metallurgical furnace, being mainly made of copper and provided with water cooling channels, said cooling element comprising a frame element that is mainly made of copper and provided with water cooling channels, refractory bricks, and fastening elements for connecting the refractory bricks to the frame element, and wherein the fastening elements are at least partly formed of elongate fastening strips made of steel, the elongate fastening steel strips are fastened to the frame element so that the elongate fastening steel strips together form in between them an open interspace, which is narrowed in a direction pointed away from the bottom of the open interspace, and the refractory bricks are arranged in the open interspace so that the refractory bricks are located at least partly in the open interspace.

12. A cooling element according to claim 11, wherein the refractory bricks together form a uniform structure with a section located in the open interspace, the measures and shape of said section at least partly corresponding to the measures and shape of the open interspace.

13. A cooling element according to claim 11, wherein the refractory bricks together form a uniform structure, which is located essentially completely in the open interspace, the measures and shape of said structure at least partly corresponding to the measures and shape of the open interspace.

14. A cooling element according to claim 11, wherein the open interspace is created by fastening elongate fastening steel strips to the frame element, so that the open interspace is created between two elongate fastening steel strips.

15. A cooling element according to claim 14, wherein there is fastened to the frame element at least one elongate fastening steel strip, the cross-sectional area of which expands in a direction pointed away from the bottom of the open interspace, so that the open interspace created between two elongate fastening steel strips is narrowed in a direction pointed away from the bottom of the open interspace.

16. A cooling element according to claim 11, wherein the open interspace is narrowed in a wedge-like fashion in a direction pointed away from the bottom of the open interspace.

17. A cooling element according to claim 11, wherein the elongate fastening steel strips are made of stainless steel, the chromium content of which is over 10.5%.

18. A cooling element according to claim 11, wherein it comprises a stopping piece for holding the refractory bricks in the open interspace.

19. A cooling element according to claim 18, wherein it includes an elongate fastening steel strip that is fastened to the frame element by machining an elongate groove in the frame element for the elongate fastening steel strip, so that the measures and shape of the section of the elongate fastening steel strip that is to be fitted in the elongate groove essentially correspond to the measures and shape of the elongate groove for forming a friction-fitted or form-fitted joint between the elongate fastening steel strip and the elongate groove.

20. A cooling element according to claim 11, wherein the bottom of the open interspace is formed of at least partly of the surface of the frame element.

* * * * *